US006031340A

United States Patent [19]

Brosius

[11] Patent Number: 6,031,340

[45] Date of Patent: Feb. 29, 2000

[54] DEVICE AND METHOD FOR CAPACITIVE BI-LEVEL SWITCHING OF HIGH INTENSITY DISCHARGE LIGHTING

[75] Inventor: William L. Brosius, Brentwood, Tenn.

[73] Assignee: MagneTek, Inc., Nashville, Tenn.

[21] Appl. No.: 09/127,200

[22] Filed: Jul. 31, 1998

[51] Int. Cl.[7] ..... H05B 37/02

[52] U.S. Cl. ..... 315/227 R; 315/240; 315/DIG. 4

[58] Field of Search ..... 315/240, 291, 315/DIG. 4, DIG. 5, 227 R, 237

[56] References Cited

U.S. PATENT DOCUMENTS

| | | | |
|---|---|---|---|
| 4,931,701 | 6/1990 | Carl | 315/240 |
| 5,227,762 | 7/1993 | Guidette et al. | 340/310 |
| 5,327,048 | 7/1994 | Troy | 315/240 |
| 5,451,843 | 9/1995 | Kahn et al. | 315/186 |
| 5,475,360 | 12/1995 | Guidette et al. | 340/315 |

*Primary Examiner*—David H. Vu

*Attorney, Agent, or Firm*—Waddey & Patterson; Mark J. Patterson

[57] ABSTRACT

A zero current crossing capacitive switching scheme for controlling the switching of a capacitor into and out of an HID lead ballast circuit at a time when a current through the capacitor is at or near zero. The capacitor switching enabling bi-level operation of an HID lamp such that the HID lamp operates at full power mode or in a reduced power mode. The zero current crossing is achieved by delaying the capacitor switching, a duration equal to about 5° to 10° lag from the zero volt crossing. The device can be used in a method of controlling a plurality of HID lamps using an isolated class 2 wiring scheme. Potential damage to the HID lamp caused by aborted lamp ignitions is also disclosed. The method includes suppressing off input signals during the warm up period.

11 Claims, 5 Drawing Sheets

DEVICE AND METHOD FOR CAPACITIVE BI-LEVEL SWITCHING OF HIGH INTENSITY DISCHARGE LIGHTING

BACKGROUND OF THE INVENTION

High intensity discharge (HID) lamps include; for example, mercury vapor, metal halide and high-pressure sodium discharge lamps. These lamps are operated with ballast circuits to control the lamp operating current because of the negative voltage-current characteristics of the discharge arc within these lamps. Conventionally, electromagnetic transformer ballasts having a series connected inductance and capacitance (L-C) circuit in the form of a "choke" and a capacitor have been employed for this purpose.

Typically the ballast, HID lamp, and reflector are combined into a fixture or luminaire. For general illumination of, for example, warehouses and factories, a large number of luminaires are suspended from a ceiling, usually at spaced distances. Generally, a plurality of the luminaires are connected in an alternating (AC) power supply branch and controlled by a simple switch or circuit breaker which is adapted to switch all of the lamps between an "off" state, in which the lamps are completely extinguished, and an "on" state, in which the lamps are operated at full rated power.

It has become desirable in other types of lighting systems, for example, a fluorescent lighting system, to employ more sophisticated controls such as occupancy sensors to turn lamps off when nobody is present in a room and to turn the lights on when someone enters. However, this is not practical for HID lamps that typically require several minutes to ignite, warm-up and reach their full output levels. Additionally, most HID lamps have hot re-strike problems which make it difficult to re-ignite a lamp shortly after being turned off while they still remain at an elevated temperature. With some lamp-ballast combinations it may take up to approximately ten minutes after a lamp has been turned off before it will re-ignite. Employing a control system which turns HID lamps completely off is not feasible because the lamps will not provide sufficient light quickly enough if someone re-enters the space shortly thereafter. Moreover, a dimming condition is often desirable, in any event, to provide emergency lighting to the area serviced by the lamps. However, if HID lamps are operated at a reduced power level instead of being completely turned off they will return to a full or near full output power level within an acceptable period of time.

Numerous lighting control systems are known in the prior art, including power line carrier control systems, and those which employ a switched-capacitor method. Power line carrier (PLC) systems which use only the power line to connect the transmitter and receivers are well known for poor performance, especially with the occurrence of noise on the power line. Frequently, erroneous noise signals cause lights to change from one level to another. So, although PLC systems need no extra control line, the inclusion of the transmitter, receiver and phase coupler make them inherently complex and hence cost prohibitive for general bi-level illumination. A more acceptable control system for general bi-level HID illumination is the switched-capacitor control system. Fundamentally, switched-capacitor control systems place capacitors in parallel for high level power, and hence, high or bright illumination, and remove one capacitor for reduced power or dimmed illumination. An alternate method is to place the capacitors in series for low level power and short circuit one capacitor for high level power.

U.S. Pat. No. 4,931,701 (Carl) shows a bi-level control system which employs a switched-capacitor using a solid state zero-voltage-crossing relay as the switching mechanism. The zero-voltage-crossing relay was said to ensure that the switching-in (or switching-out) of the switched-capacitor is timed to occur at a zero-crossing point of the applied voltage. This applies or removes the switched-capacitor only when the voltage is not able to cause excessive voltage spikes or surges by switching the switched-capacitor if it is partly or fully charged when switched. Such partial or fill charge switching can cause damage to other components in the circuit. A disadvantage of such a solid state relay is that it allows a small current flow to the switched-capacitor unless the relay is specifically switched for dimming the lamp. The small current flow to the switched-capacitor has been found to cause unintentional dimming of the lamp from the full light output level. HID lamps inherently have a 5° to 10° phase lag, where the current lags the voltage. Hence, when voltage is zero across the switched-capacitor (in an HID lamp), there is still a small current flowing through the switched-capacitor. One object of the present invention is to utilize this inherent time delay to achieve capacitor switching during a zero current crossing. It has also been found that such a relay false triggers and closes at times other than zero-crossing of the input voltage to the lamp. Another disadvantage to Carl is that it uses a two-wire control circuit. Two-wire control circuits are an added installation expense that increases substantially when many luminaires are hung at a spaced distance. Such hanging configurations often occur in warehouses and factories.

U.S. Pat. No. 5,327,048 (Troy) attempts to alleviate some of the problems of a Carl-type control system. Troy teaches away from using zero-crossing relays. A specific objective of Troy is to protect ballast and relay components from current surges upon the switching out of switched-capacitor without employing solid state zero-crossing relays. Troy employs a ballast L-C circuit in series with the switched-capacitor. Troy also reduces the control circuit wiring. In Troy, one of the input lines of the capacitance switching means is connected to the common-line of the AC branch circuit and the other control line input is connected to the output of the control means with a single control line. Thus, the control means is effective to control the switching of said capacitance-switching means with a single control line by switching the source of electric potential to the output of the control means. Since the capacitance-switching means is connected to the same common line as the ballast and only a single control line connects the capacitance-switching means to the control, less wiring is needed than in Carl.

U.S. Pat. No. 5,451,843 (Kahn) also teaches away from the use of zero-crossing relays. Kahn shows a housing containing a control device comprised of a dual capacitor and a "random-crossing" relay connected to the capacitor. A single electrical control wire, similar to that in Troy is used. The control includes a switching relay of the random-crossing type. The relay is connected to and switches one of the capacitors into, or out of, the circuit. Such switching is irrespective of the instantaneous value of voltage across the switch terminals of the relay. The control device also includes an inductor, a terminal of which is connected to a capacitor. The inductor attenuates voltage "spikes" that can occur when the relay switches the charged capacitor in or out. Such voltage attenuation has the effect of limiting surge current.

It is desirable to develop a control device capable of switching the switched-capacitor when the current through said capacitor is zero or near zero. Such a device would reduce the need for inductor-capacitor "choke" surge protection components. Incorporating a simple Class 2 wiring scheme would further reduce installation costs for a plurality of luminaires hung at a spaced distance because additional conduit for the wiring of the control system would not be needed. Turning an HID lamp off during the warm up period of the lamp can potentially damage it. A method to prevent this potential damage would also be desirable.

SUMMARY OF THE INVENTION

This invention relates to what is known, generally, as a bi-level lighting system which provides two different levels of illumination depending upon the level of electric power consumed by fixtures within such systems. The control system, generally known as a switched-capacitor control system, changes the power level, and hence illumination level, by switching a capacitor in or out of the current path to the lamp. One arrangement places the capacitors in parallel for high power and removes one for low power. Another arrangement places the capacitors in series for low power and short circuits one for high power. Timing, for switching the capacitor in and out of the circuit, is critical for reducing damage to other components due to arc discharge from current built up in said capacitor. An improvement, incorporated in this invention, is such that the switch is activated when the current is at or near zero. A further improvement is an "off input" suppression method whereby off inputs to the HID lamp are suppressed during the warm up period, approximately ten minutes.

High intensity discharge (HID) lead circuit ballasts naturally have a voltage-current (V/I) phase relationship such that the current lags the voltage by 5° to 10°. Switching at zero current is accomplished by measuring or detecting when the voltage across the switched-capacitor is at or near zero, activating the switch network, waiting an appropriate time delay, then switching the switch to switch the switched-capacitor out of (or into) the circuit path to the lamp. The appropriate time delay to use is determined by the V/I phase relationship. More concretely, an embodiment of the invention employs a zero-voltage crossing detect optotriac driver for detecting zero-voltage. Upon application of a DC voltage of approximately 5-V from a high/low to neutral (Hi/Lo to N), the triac driver waits until the voltage on the master switching module "switched-capacitor" switch (and hence, the voltage across the switched-capacitor) is at or near zero before it activates the switching network. There is a time delay between when the switching network is activated and when the triac driver actually switches on and switches the "switched-capacitor" in (or out) of the circuit. A network time constant is chosen such that a time delay of about 5° to 10° is achieved. Resistor and capacitor values are selected to obtain the chosen time constant. Another embodiment of the invention employs a microprocessor, instead of time-selected R and C values, to achieve a similar time delay.

If an "on input", an input to turn the HID lamp on, is followed by an "off input" during the warm up period, the lamp and associated circuitry, can be damaged. Such input may come from a motion detector, "on-switch", a timer, and similar sources. An embodiment of this invention employs a micro processor to suppress "off" input signals from similar sources if the off input signals occurs during the warm up period of the lamp, a period of approximately 10 to 15 minutes.

Prior art, (Troy and Kahn), employing a single-wire control wiring scheme use a system power wire as a reference point and a system neutral as one of the control wires. Since there is no isolation in those schemes, the control wires must be run in conduit. An embodiment of this invention uses an isolated simple Class 2 wiring scheme. More specifically, the wiring scheme includes a power line from a stepped down power source supplying power to the switching module, a switching module neutral line and a control wire feeding into the switching module. Isolation is provided by an optotriac driver, a 5-V step-down transformer, a full wave bridge rectifier, a filter, capacitor and voltage isolation. As such, this embodiment does not have to be run in conduit; thus, allowing for much easier and cost effective installation.

In another embodiment of the invention, multiple switching modules use similar time delay switching methods, off input signal suppression, and wiring schemes as described above, wherein one of the modules acting as a master switching module, controls the timing.

DESCRIPTION OF THE PREFERRED EMBODIMENTS

Figure 1:
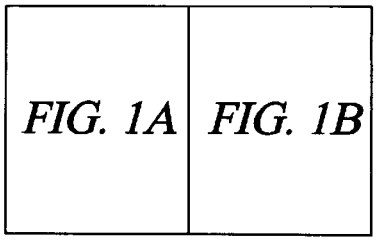
FIG. 1 is a schematic diagram of a first embodiment of the invention, showing a scheme for controlling capacitor switching at zero current crossing. It includes optotriac detection devices U3 and U4 to detect zero voltage crossings, transistor Q3 to create a time delay equivalent to the current, switched and unswitched capacitors Cs and Cu, high intensity discharge lamp HL, and low power supplied by a step down transform T and full wave bridge rectifier B.
Figure 1A:
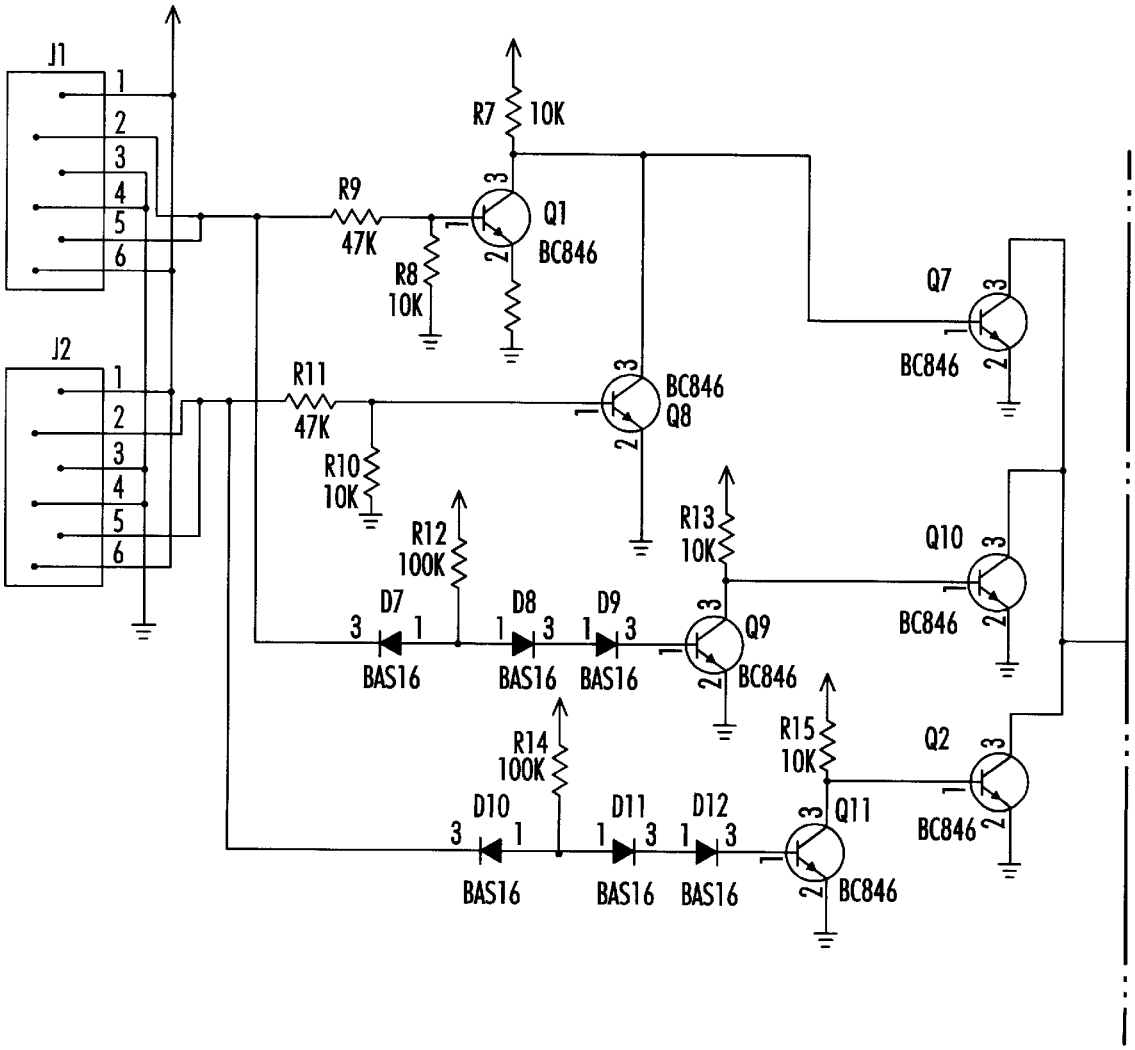
Figure 1B:
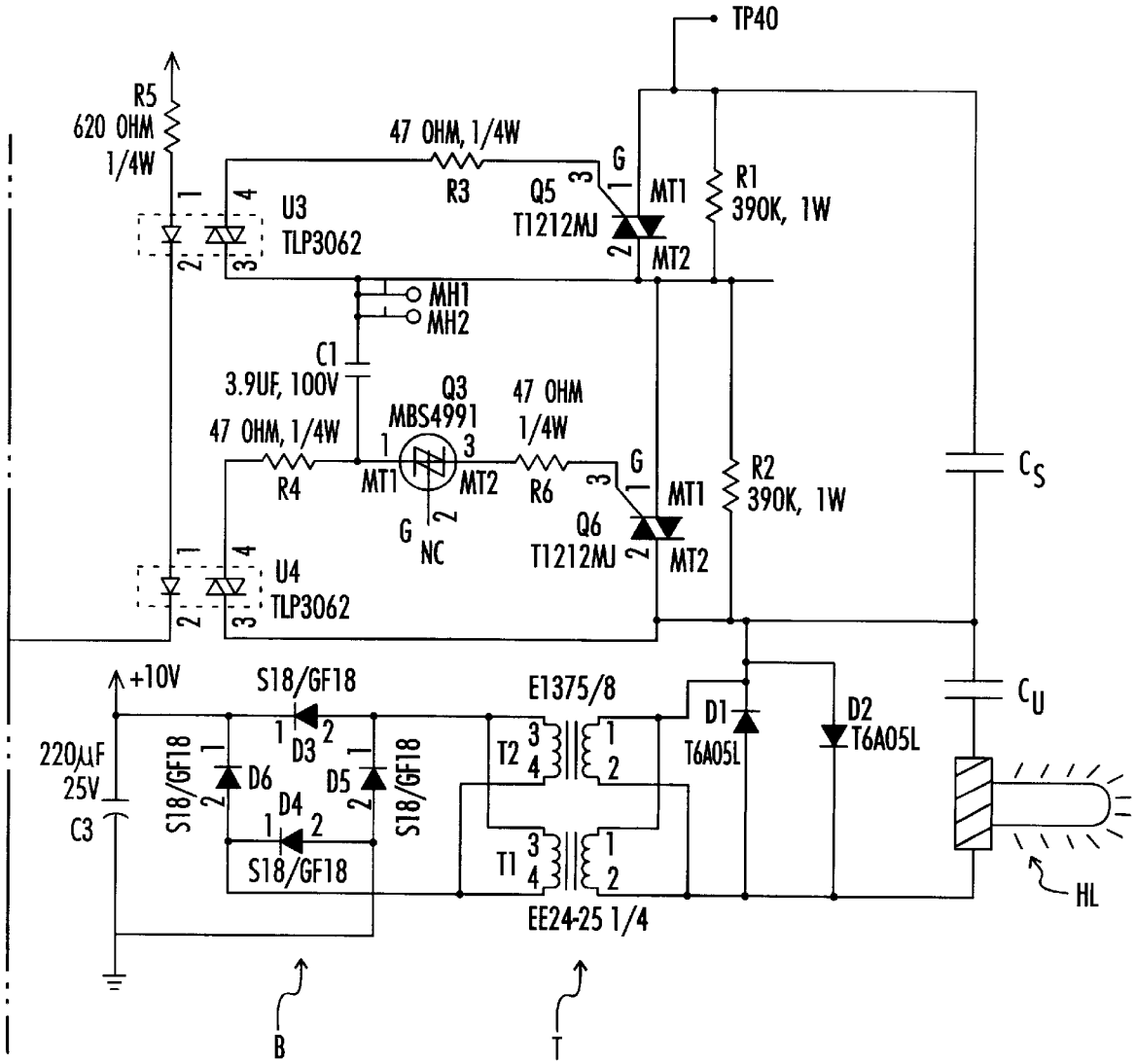

Applicant's invention will be best understood when considered in light of the following description of the preferred embodiment of the invention, as illustrated in the attached drawings wherein like reference numerals and characters refer to like parts.

This invention relates to what is known, generally, as a bi-level lighting system which provides two different levels of illumination depending upon the level of electric power consumed by fixtures, or luminaires, within such systems. The controlled system employed is generally known as a switched-capacitor control system, which switches a capacitor in or out of the current path to the lamp to change the power level and hence illumination level of the lamp. High intensity discharge lead circuit ballasts naturally have a voltage-current phase relationship such that the current lags the voltage by 5° to 10°. Switching at zero current crossing reduces potential damage to the HID lamp and associated circuitry due to arcing when the capacitor is switched in or out of the current path.

FIG. 1 shows a switching circuit for controlling capacitor switching at zero current crossing. Optotriac detect devices U3 and U4 provide power isolation and have internal zero-voltage crossing detection circuits that cause the devices U3 and U4 to switch "on" when zero voltage crossing is detected. Switch Q3 creates a time delay between when U3 detects zero voltage and when bilateral switch Q6 will be turned on. To achieve a time delay corresponding to 5° to 10° current lag, the breakover voltage of switch Q3 is chosen to be approximately 6 to 7 volts. When the capacitor to be switched Cs is in series with the unswitched capacitor Cu, the lamp HL is in a low, or dimmed, power setting. Shorting the switched capacitor, in essence, switching Cs out of the circuit, results in a high power setting. The high intensity discharge lamp is indicated by HL. Low power is provided by the step down transformer T, and the full wave bridge rectifier B.

Figure 2:
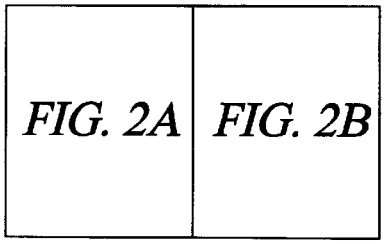
FIG. 2 is a schematic diagram of a second embodiment of the invention, implementing the control scheme similar to that shown in FIG. 1, further including a microprocessor U1 to suppress "off" input signals during the lamp warm up period and to damp spurious inputs.
Figure 2A:
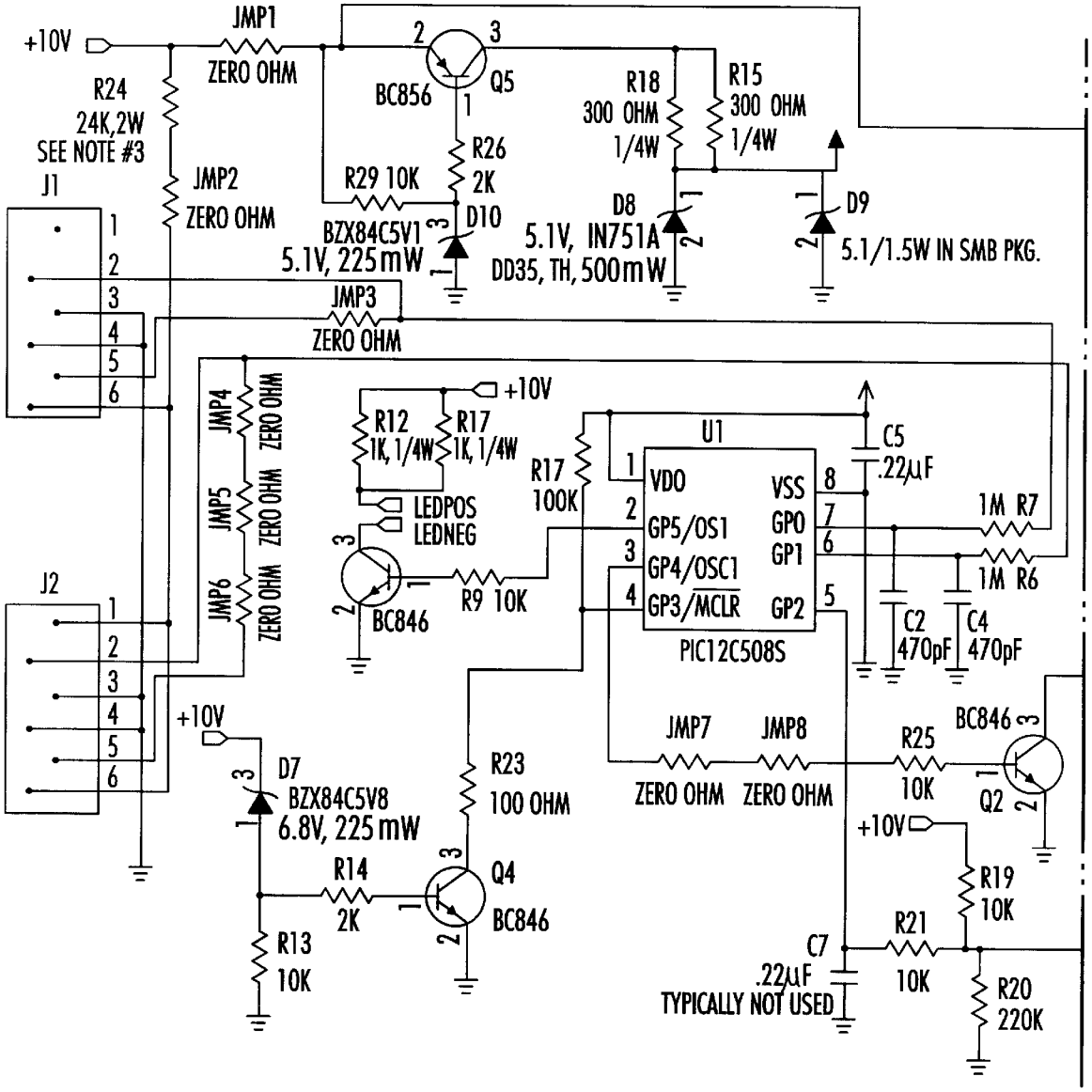
Figure 2B:
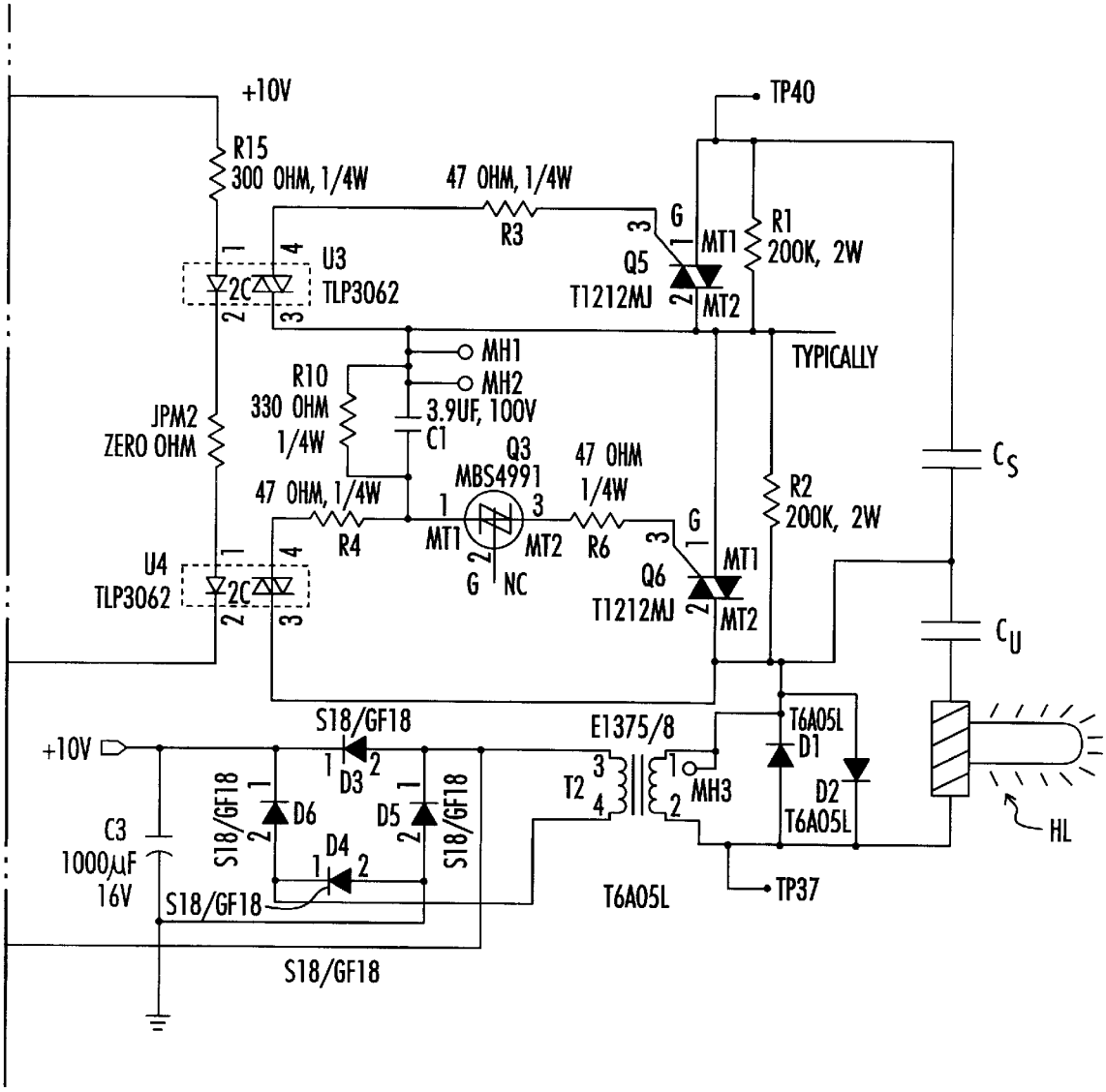

FIG. 2 shows a switching circuit similar to that shown in FIG. 1, further including a microprocessor U1. The microprocessor U1 operates to damp spurious input signals and suppress "off" or reduced power input signals during the warm up period of the HID lamp.

Figure 3:
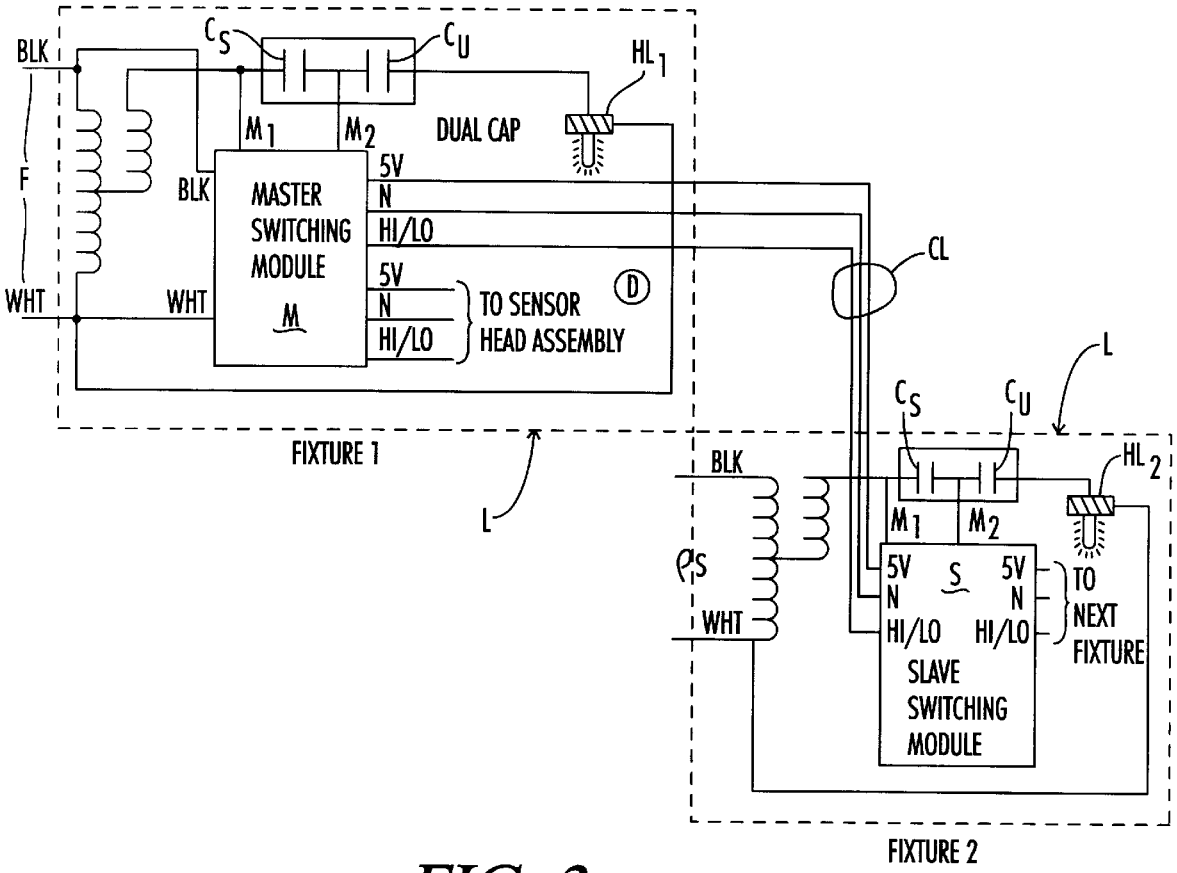
FIG. 3 is a block wiring diagram of the invention as used to control a plurality of HID lamps.

FIG. 3 shows a plurality of luminaires L controlled from a first switching module M, acting as a "master switching module," via an input device D such as a motion sensor, heat sensor, manual or timed switch or similar input generating devices. The one or more other switching modules S, acting as a "slave module," are controlled by the first switching module M which is in turn triggered by a dimming control signal from device D. The wiring scheme of the switching modules M and S may be similar to the wiring schemes shown in FIGS. 1 and 2, but need not be. Preferably, each secondary switching module S is connected to the master switching module M using low voltage Class 2 wiring. Also, it is preferred that each switching module M and S be identical electronically but capable of functioning in either a master or slave capacity in the system.

A preferred embodiment for a device to control capacitor switching at zero current crossing is shown in FIG. 2. The following description references FIG. 2. An input signal is received at connections J1 and J2. The input signal may come from sources such as detectors, sensors, timers, manual switches and the like. The input signal is routed to a microprocessor, U1. The microprocessor holds the input signal at a steady state for a few seconds to eliminate spurious inputs and such. An output of the microprocessor, GP4, transmits a control signal to the base of transistor Q2.

HID lamps require a warm up period of approximately 10 to 15 minutes to achieve full brightness. Turning the lamp HL off, or reducing the power setting, during the warm up period may lead to damage of the lamp and associated circuitry. To limit this potential damage, the microprocessor is programmed to suppress any "off" input signals during this warm up period so that the lamp HL is operated at full power for a minimum warm-up period, typically 15 minutes. The "off" input may be any signal directing, or calling for, a reduction of power. Thus a signal to turn the lamp HL from high power to medium or low would also be considered an "off" input or dimming control signal.

An "off" input will not be transmitted to transistor Q2 during the warm up period. The "off" input may be stored in the microprocessor U1 and be transmitted after the warm up period or the input may be shunted, requiring another off input signal after the warm up period.

When transistor Q2 is turned on, the output is routed to optotriac detect devices U3 and U4. The detection devices U3 and U4 have internal zero crossing detection capability. The zero crossing capability opens a path from one side of the device to the other side of the device on the zero crossing following the command, or signal, to do so. Once the signal is sent to the zero crossing devices U3, the device waits for the next zero voltage crossing to occur, then allows current to flow across the optical connection. The optical connection provides isolation from the high voltage power supply.

Bilateral switch Q5 turns on right after U3 allows current to flow. However, transistor Q3 has a breakover voltage chosen to delay turn-on of switch Q6. In an HID lamp circuit, current zero crossings lag voltage zero crossings by approximately 5° to 10°. To switch the capacitor Cs at a zero current crossing, when no current is flowing through the capacitor to be switched, switch Q6, in the network, must be turned on after a delay equivalent to a 5° to 10° lag after the voltage crosses zero. In this network, a breakover voltage for Q3 approximately equal to 6 to 7 volts would yield the desired delay. Thus capacitor switching to provide bi-level power operation is accomplished when current through the capacitor is zero. This reduces potential damage due to discharge arcing.

Although the delay introduced by the switching circuit shown in FIGS. 1 and 2 are a function of the operation of switch Q3, other delay techniques circuits and devices can be used, such as a conventional resistor-capacitor network or a microprocessor.

Suitable components usable for optotriac devices U3 and U4 are type TLP3062 devices from Toshiba Electronics. Switch Q3 can be a type MBS4991 from Motorola, Inc. Switches Q5 and Q6 are type T1212MJ from ST Microelectronics. The microprocessor can be a PIC12C508S from Microchip Technologies.

This preferred embodiment also uses an isolated simple Class 2 wiring scheme, as shown in FIG. 3. A first or "master" switching module M and one or more other or "slave" switching modules S are connected to a stepped down power source PS supplying power to the switching modules. The master switching module M receives signals from device D that determine the "high/low" operational mode for the HID lamps HL. Upon receipt, for example, of a dimming control signal from device D, the master switching module M operates as described above to switch the switched capacitor Cs in and out of the circuit at zero-current crossing, to control the light output from lamp HL1. The dimming control signal is also communicated via Class 2 control lines CL to the slave switching module S so that lamp HL2 can be controlled at the same time and in response to the same dimming control signal. The control lines CL will include a low voltage line Gabeled 5V), a HI/LO control line, and a neutral line. Accordingly, multiple HID lamps may be safely dimmed in response to a single sensing or control device D without having to run conduit or other expensive high voltage interconnection between the lamps.

Thus, although there have been described particular embodiments of the present invention of a new and useful "Device And Method For Capacitive Bi-Level Switching Of High Intensity Discharge Lighting," it is not intended that such references be construed as limitations upon the scope of this invention except as set forth in the following claims.

What is claimed is:

1. A device for switching an HID lamp between a full power mode and a reduced power mode comprising:

an unswitched capacitor electrically connected to the HID lamp;

a switched capacitor electrically connected to a switching circuit, the switching circuit including a switch for switching the switched-capacitor into or out of electrical connection with the unswitched capacitor in response to a dimming control signal such that the HID lamp is switched between the full power mode and the reduced power mode;

the switching circuit including a voltage detect device for detecting when a voltage across the switched capacitor is zero, a delay circuit for achieving a time delay substantially equal to an elapsed time between when the voltage detect device detects the zero voltage across the switched-capacitor and when current through the switched capacitor will be at or near zero; and the switch responsive to the time delay such that the current through the switched capacitor is at or near zero when the switched-capacitor is switched.

2. The device of claim 1 wherein the time delay corresponds to a current-voltage phase delay in the range of about 5° to 10°.

3. The device of claim 1 further comprising a lamp protection circuit for inhibiting switching of the HID lamp from the full power mode during a lamp warm-up period.

4. The device of claim 1 wherein the voltage detect device comprises an optotriac driver.

5. An apparatus for switching a plurality of HID lamps between a high power mode and a low power mode in response to a dimming control signal comprising:

a first switching module operatively connected to control one of the HID lamps and connected to receive the dimming control signal;

at least one secondary switching module associated with each of the other HID lamps;

each secondary switching module electrically connected to the first switching module such that the secondary switching module can respond to the dimming control signal from the first switching module;

the first switching module and each secondary switching module having a switched capacitor and a switching circuit having a switch for switching the switched capacitors in and out of power circuits to the HID lamps in response to the dimming control signal to cause the HID lamps to switch between the high power mode and the low power mode;

each switching circuit including a voltage detect device for detecting when a voltage across the switched capacitor is zero, a delay circuit for achieving a time delay substantially equal to an elapsed time between when the voltage detect device detects the zero voltage across the switched-capacitor and when current through the switched capacitor will be at or near zero; and each switch responsive to the time delay such that the current through each switched capacitor is at or near zero when the each switched capacitor is switched.

6. The apparatus of claim 5 wherein the secondary switching modules are electrically connected to the first switching module using a low voltage connection.

7. The apparatus of claim 6 wherein the low voltage connection comprises Class 2 wiring.

8. The apparatus of claim 5 further comprising a lamp protection circuit operative to inhibit switching of the HID lamps from the high power mode during a pre-determined lamp warm-up period.

9. The apparatus of claim 8 wherein the lamp protection circuit comprises a microprocessor.

10. A method of switching an HID lamp between a high illumination level and a low illumination level in response to a dimming control signal comprising the steps of:

sensing a varying load voltage across a switched capacitor to determine a voltage zero-crossing time;

switching the switched capacitor in and out of a load circuit to the HID lamp only at the end of a pre-determined delay period following the voltage zero-crossing time, the delay period corresponding to when a varying load current through the switched capacitor is substantially zero.

11. The method of claim 10 further comprising the step of inhibiting switching of the HID lamp from the high illumination period during a lamp warm-up period.

* * * * *